US005732853A

United States Patent [19]

Ganzeboom et al.

[11] Patent Number: 5,732,853

[45] Date of Patent: Mar. 31, 1998

[54] DOSING UNIT COMPRISING A DISPENSING DEVICE AND A CONTAINER BAG UNIT

[75] Inventors: Wilhelmus Everhardus Ganzeboom, Aerdenhout; Wouter Jan Ten Wolde, Bentveld, both of Netherlands

[73] Assignee: Bentfield Europe B.V., Nieuw-Vennep, Netherlands

[21] Appl. No.: 824,840

[22] Filed: Mar. 26, 1997

Related U.S. Application Data

[63] Continuation of Ser. No. 428,232, May 1, 1995, abandoned.

[30] Foreign Application Priority Data

Nov. 3, 1992 [NL] Netherlands ..... 9201919

[51] Int. Cl.[6] ..... B67D 5/00

[52] U.S. Cl. ..... 222/82; 222/83; 222/89; 222/181.3; 222/388

[58] Field of Search ..... 222/81, 82, 83, 222/83.5, 88, 89, 105, 181.3, 388

[56] References Cited

U.S. PATENT DOCUMENTS

| | | | |
|---|---|---|---|
| 3,809,293 | 5/1974 | Chappell | 222/181.3 X |
| 3,912,125 | 10/1975 | Acklin | 222/181.3 X |
| 4,322,019 | 3/1982 | Smith | 222/83.5 |
| 4,381,846 | 5/1983 | Heck | 222/105 |
| 4,576,313 | 3/1986 | Smith et al. | 222/81 |
| 4,798,605 | 1/1989 | Steiner et al. | 222/83 X |
| 4,903,865 | 2/1990 | Janowitz | 222/83.5 |
| 5,127,550 | 7/1992 | Knorr | 222/83 |
| 5,147,070 | 9/1992 | Iwamoto | 222/83 |
| 5,325,983 | 7/1994 | Imai et al. | 222/83 X |
| 5,413,153 | 5/1995 | Burrows | 222/83.5 X |

FOREIGN PATENT DOCUMENTS

| | | |
|---|---|---|
| 0 127 449 | 8/1987 | European Pat. Off. . |
| 2 499 517 | 8/1982 | France . |
| 2 617 825 | 1/1989 | France . |
| 87 16 846 | 2/1988 | Germany . |
| 67 564 | 7/1973 | Luxembourg . |

*Primary Examiner*—Joseph Kaufman
*Attorney, Agent, or Firm*—Young & Thompson

[57] ABSTRACT

Dosing unit comprising a dispensing device and a container bag unit. The container bag unit has an imperforate wall. A sleeve-shaped part having an opening therethrough is secured to the wall, the wall closing one end of the sleeve-shaped part. A piercing element with a point is disposed within the sleeve with its point directed toward the wall. A dispensing device is receivable in the end of the sleeve-shaped part opposite the wall to engage the piercing element and to move the piercing element relative to the sleeve to pierce the wall to permit flow of the contents of the bag unit through the sleeve-shaped part and to and through the dispensing device. The piercing element is fixed to the sleeve-shaped part by a rupturable connection that breaks when the dispensing device presses against the piercing element.

3 Claims, 3 Drawing Sheets

DOSING UNIT COMPRISING A DISPENSING DEVICE AND A CONTAINER BAG UNIT

This application is a continuation of application Ser. No. 08/428,232, filed May 1, 1995, now abandoned.

FIELD OF THE INVENTION

The invention relates to a container bag unit.

BACKGROUND OF THE INVENTION

In U.S. Pat. No. 4,576,313 a closed flexible bag is disclosed inside which the coupling means are fitted. Moving these coupling means, which are in the form of a pipe, to a certain position of the bag and then placing them in the dispensing device produces a connection between said coupling means and the dispensing device. In this case the bag material is pierced on placing on the dispensing device. This piercing is carried out by a sharp point provided in the dispensing device. Such flexible bags are preferred from the point of view of transport and use. If, for example, the contents of such bags have to be sprayed, the viscosity is important. If an open container is used in such a case, after some time evaporation and other environmental influences will cause thickening of the contents, so that spraying becomes very difficult or even impossible. Another problem is transport. In the case of open containers or containers which are provided with a stopper, there is always a risk that they will open in transit, in particular if they are being transported in airplanes and the like where low pressure occurs. The result is that the whole batch, and not just the container concerned, is rejected, because undesirable leakage is often unavoidable. This disadvantage can be prevented by using a sealed bag, but the problem here is that an opening has to be made afterwards. For that reason, it is proposed in the prior art that the dispensing device should be provided with a sharp pin or the like which pierces a part of the container when the container bag unit is placed on the dispensing device. Such a pin must meet high standards because it has to last at least as long as the dispensing device. This means that it must be made of a hardened steel part, with the result that there is a real risk of injuries. For, it is quite conceivable for the user to act so clumsily that, instead of the container bag unit, part or parts of the body are brought close to the accommodation part of the dispensing device.

German Gebrauchsmuster 8716846.4 discloses a rigid plastic container provided with a cover which falls along with the level of the contents. This to some extent prevents drying out, but the transportation problem remains. If excess pressure is present in the container, the cover will move outwards when there is a reduction in the pressure of the ambient air. This rigid plastic container is provided with a weakened part, by means of which an opening can be made before use by means of a pin fitted on the dispensing device. This pin fitted on the dispensing device is a projecting part, which gives rise to the abovementioned risk of injury.

LU-A-67,564 discloses a rigid plastic container which is provided with a sealing stopper. This stopper is pressed inwards by a pin projecting from the dispensing device. The use of such a stopper means that during transport and storage in particular there is a risk that pressure acting on the container bag will cause the stopper to shoot out, with all the abovementioned consequences.

From FR-A-2,499,517 a rigid bottle is known of which the opening is sealed by a membrane. On the neck, a support is connected having a hollow piercing member which projects outwardly in the condition of non-piercing of the membrane.

The membrane is pierced by moving the piercing member inwardly which is realized by a screw threaded auxiliary part. After piercing the membrane, the contents of the bottle can be emptied. Nowhere is any suggestion given for combination with a dispensing device.

From EP-B-0127,449 a container is known being provided with a spraying head.

OBJECT OF THE INVENTION

The object of the present invention is to avoid the disadvantages described above and to provide a container bag unit in which the container can be placed on the dispensing device without any problem.

SUMMARY OF THE INVENTION

The invention is based on the idea of fitting the piercing means on the outside of the flexible bag. The laborious search for the pipe in the flexible bag and the positioning in a specific direction are consequently no longer necessary. The place at which the coupling means are fitted is clear and well defined. Welding them to the container bag provides a sturdy connection, while there is little or no adverse effect on the strength of the bag, i.e. the bag also stretches inside the coupling means in the same way as before the fitting of the coupling means.

Firstly, fitting the piercing means in the coupling means ensures that the piercing means need be used only once, namely purely for use with the container concerned. The result is that a relatively simple plastic part will suffice, and it can often be made of the same material as the coupling means and as a part thereof.

Secondly, this means that the pointed side of the piercing means can be accommodated in the coupling means and that only the contact part—i.e. the part on which the pressure is to be exerted—of the piercing means is accessible from the outside. Of course, this contact part need not be sharp, but must only be capable of transmitting forces.

According to an advantageous embodiment of the invention, the coupling means comprise a sleeve-shaped part through which the product flows, inside which the piercing means are fitted. This is a particularly simple embodiment, and such a design can be made in one construction operation. It is, of course, also possible to have loose piercing means which are confined between two edges in the sleeve-shaped part.

The piercing means can comprise any means known in the prior art, but it is preferable for them to comprise a pointed element with ribs, in which the point is, of course, directed towards the container to be pierced. According to a further advantageous embodiment in which the piercing means are made integral with the coupling means, a connection is made with the coupling means, or the abovementioned sleeve-shaped part, by means of a break connection. When said break connection is removed, the piercing means come away from the coupling means, and the container can be pierced by exerting pressure thereon from the side which is not pointed. The projecting part remaining on the coupling means can be used for, for example, snapping the accommodation part of the dispensing device into a groove. It is also possible to accommodate the piercing means in such a way that they are freely movable in the sleeve-shaped part.

The flexible bag and the coupling means are preferably made of the same material, but with different densities. An example is the use of high-density polyethylene for the bag and low-density polyethylene for the coupling means. Such materials are easily welded together. The bag can, of course, comprise a laminated construction in which the coupling means are welded only at the outermost layer of the laminate. Since polyethylene in particular is a relatively soft material, it is preferable in such a case to make the piercing means from another, harder material.

The present invention also relates to a dispensing device for use in combination with the container bag unit described above. According to the invention, it is provided with accommodation means for the coupling means, which accommodation means are provided with operating means for the piercing means. Said operating means can comprise a projecting part which engages on the non-pointed side of the piercing means. When the coupling means are made sleeve-shaped, it is possible for these accommodation means to lie extended inside the sleeve-shaped part. Through the exertion of a force, a break connection—if present—between the sleeve-shaped part and the piercing means will be removed, and force will then be exerted on the piercing means in order to pierce the container.

It goes without saying that the container bag unit described above can be used on a dispensing device for dispensing any type of product. Through the use of a bag in which the material to be dispensed is stored, it can be guaranteed that the quality of such product remains substantially unchanged during the service life of the bag. For example, if soap is stored in containers which have to be aerated to replace the volume of soap dispensed, the viscosity of the soap will increase in the prior art through thickening. Through the use of a flexible bag it is possible that the quality of the product remains substantially the same. Because of that it is possible to dispense the soap not only in droplets but as a spray. Dispensing as a spray is particularly advantageous for soap materials. It has been found that when soap is dispensed as a spray, a 50 to 60% saving in soap can be realized while the user still finds that the quantity of soap dispensed is adequate. Through spraying the soap material will foam somewhat giving the user the impression that the substantial portion of soap has been received having a certain thickness. If dispensing in a spray is used, preferably this is realized in downward direction. This is particular true for dispensing of soap for washing hands. First of all the user is familiar with the fact that the material to be dispensed will egress from the lower side of the dispensing device. On the other hand it is not preferable that a spray is directed in horizontal or vertically upward direction. Finally dispensing from the lower side of the dispenser makes gravity feed of the related pump possible so that it is possible to obviate problems relating to riser tubers and so on. If soap is dispensed in a spray its viscosity is preferably between 0.3–4000 d.Pa.s (poise). It has to be understood that the flexible bag described above in combination with a spray dispenser having a pump can be provided with any kind of connection and is not limited to the coupling means as described above. It has been observed that 0.23 ml per spray is sufficient whilst in the prior art dosing quantities are about 1–1.5 ml. For dispensing spray it has been found advantageous to realize the nozzle head of the dispensing device as the most protruding part of the dispensing device. This prevents contamination of portions surrounding the atomizing nozzle.

BRIEF DESCRIPTION OF THE DRAWINGS

The invention will be explained in greater detail below with reference to an example of an embodiment shown in the drawing, in which.

DETAILED DESCRIPTION OF THE INVENTION

Figure 1:
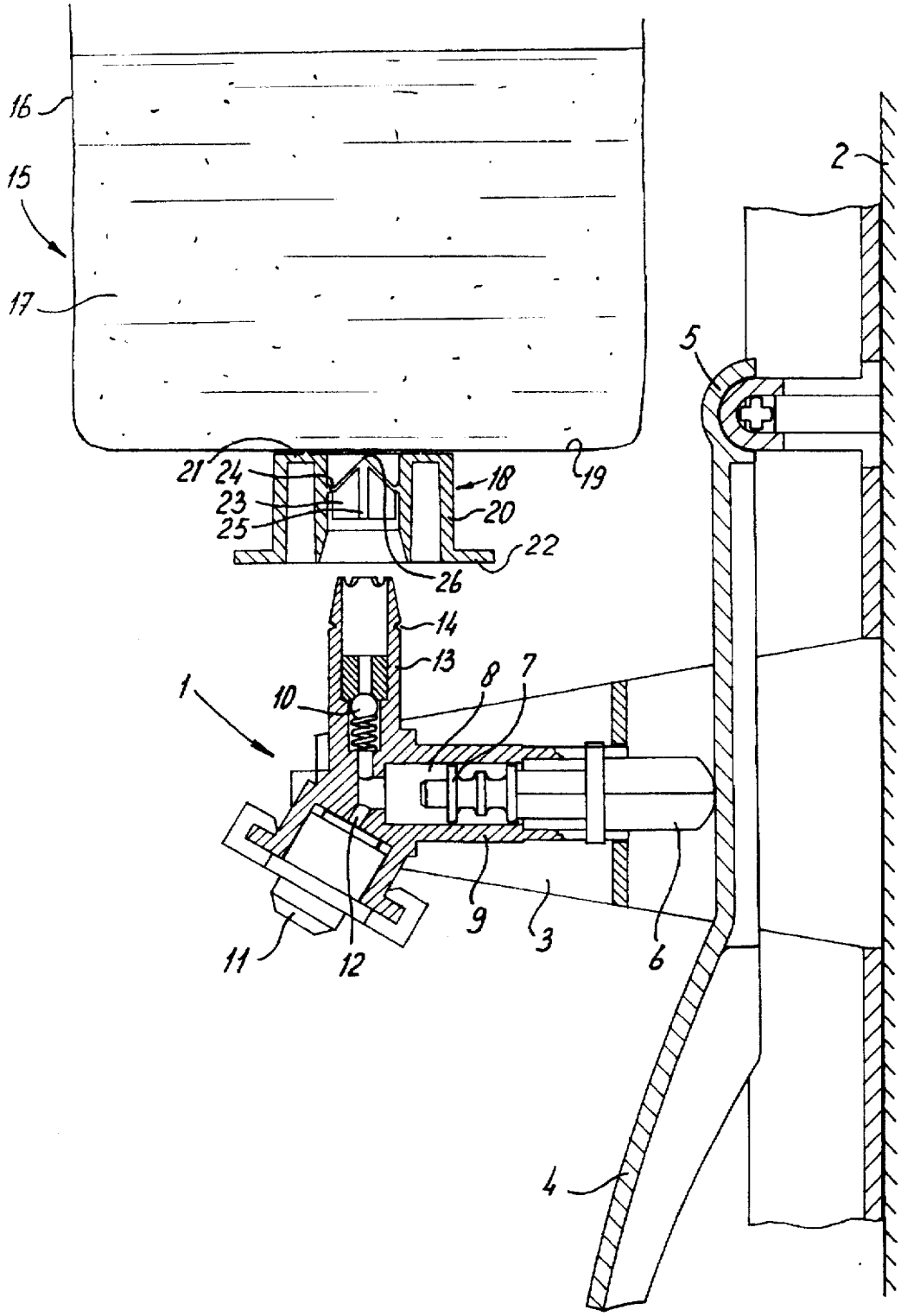
FIG. 1 shows diagrammatically and partially in cross-section the container bag unit according to the invention, together with the dispensing device according to the invention, in the detached state before positioning thereof.

FIG. 1 shows a dispensing device 1, which is fixed to a support 3, in turn fixed to wall 2. Operating lever 4 is fixed to support 3 by means of hinge 5. Operating lever 4 acts upon pressure piece 6, which in turn operates piston 7, which is accommodated inside a bore 8. Spring means may be present if necessary, for the purpose of driving piston 7 to the right in the figures, so that a pumping action is obtained by moving operating lever 4 to the left. Bore 8 is accommodated inside housing 9. Housing 9 contains a non-return valve 10 in the channel leading to accommodation sleeve 13. Spray head 11 is present in the housing 9 and is connected by way of channel 12 to bore 8. Assuming a supply of, for example, soap into accommodation sleeve 13, when piston 7 moves to the right material will be moved by way of non-return valve 10 into bore 8. A non-return valve may be present in nozzle 11, or the openings of the spray nozzle 11 are made so small that when piston 7 is moved back quickly such a vacuum is produced that the force of non-return valve 10 is overcome and material flows into bore 8. When lever 4 moves to the left in the figures non-return valve 10 will close, due to the fact that pressure is built up inside bore 8. The material, such as soap material, will then be dispensed to the user in mist form by way of spray nozzle 11. It has been found that in the case of soap in particular this can lead to a considerable saving in use. When soap is not dispensed in the form of a mist it has been found that approximately 80% is flushed away without being used. It has been found that a saving of at least 50% is possible through spraying.

The soap described above comes from the container bag unit 15. This comprises a bag 16, which is provided with soap 17. Container bag unit 15 is also provided with a coupling 18. Bottom 19 of container 16 is attached to said coupling 18 without an opening being present here in the situation shown in FIG. 1. Coupling 18 comprises a sleeve 20, to which a piercing piece 23 is fixed by means of a break connection 24. Connected to sleeve 20 is an edge 21, which is in turn connected to flange 22. Piercing piece 23 comprises an element provided with a point 26. This element is also provided with ribs 25, so that throughflow channels are bounded. Accommodation sleeve 13 is provided with a peripheral groove 14.

FIG. 1 shows the situation before coupling. In this case point 26 is directly below the bottom 19, but bag 16 is still completely sealed off.

Figure 2:
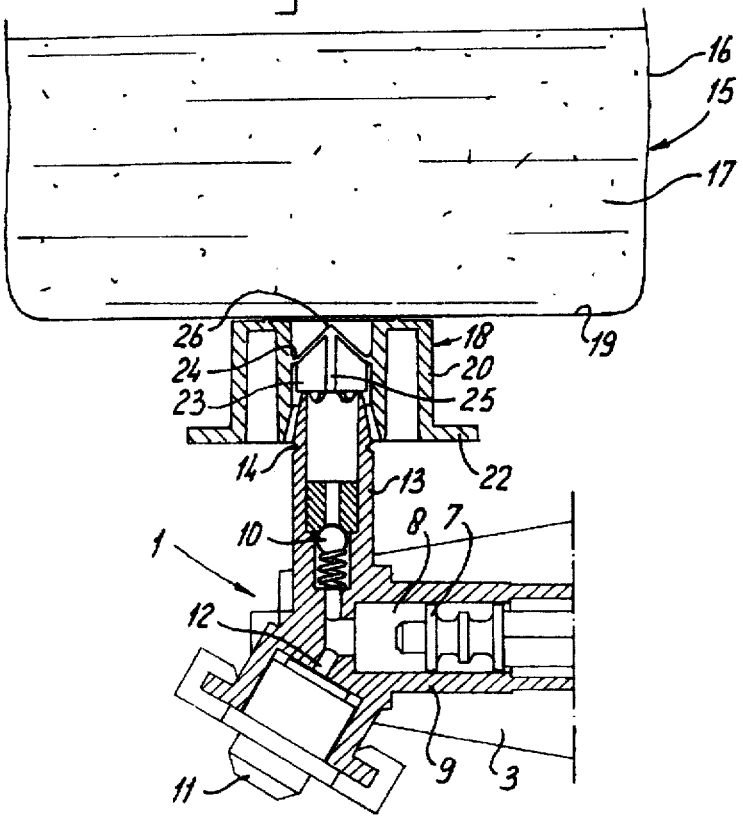
FIG. 2 shows the construction according to FIG. 1, in which the container bag unit is just placed on the dispensing device.
Figure 3:
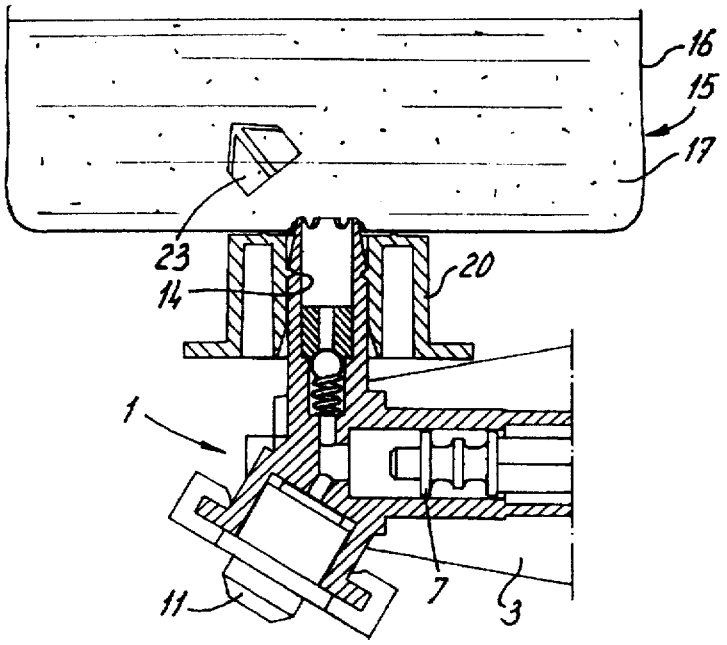
FIG. 3 shows the construction according to the preceding figures, in which the container bag unit is fully placed on the dispensing device.

FIG. 2 shows the situation when container bag unit 15 is placed without force on accommodation sleeve 13. The stop is formed through contact of the bottom side of piercing piece 23 with the top side of accommodation sleeve 13. When further pressure is exerted the bottom side of piercing piece 23, which is resting against accommodation sleeve 13, will be forced into position relative to sleeve 20. In this case the break connection 24 is first destroyed, and point 26 pierces bottom 19. In the course of this the piercing piece 23 shoots off into the bag 16, as shown in FIG. 3. On further movement, the parts of break connection 24 remaining on sleeve 20 snap into groove 14, so that a snap connection is obtained. The presence of flange 22 facilitates the placing of the container bag unit on the dispensing device.

Any plastic material known in the prior art can be used for the bag 16. The seine applies to the coupling means. It is, however, preferable to use parts which are easily connected to each other. For example, the bag can be made of high-density polyethylene and the sleeve of low-density polyethylene, materials which are relatively easily welded to each other. It is possible here that the piercing piece may not be sharp enough to pierce the bag, particularly if the bag is made of a laminate in which the outer layer is made of polyethylene. In such a case the piercing piece must be made of a much more rigid material.

Figure 4:
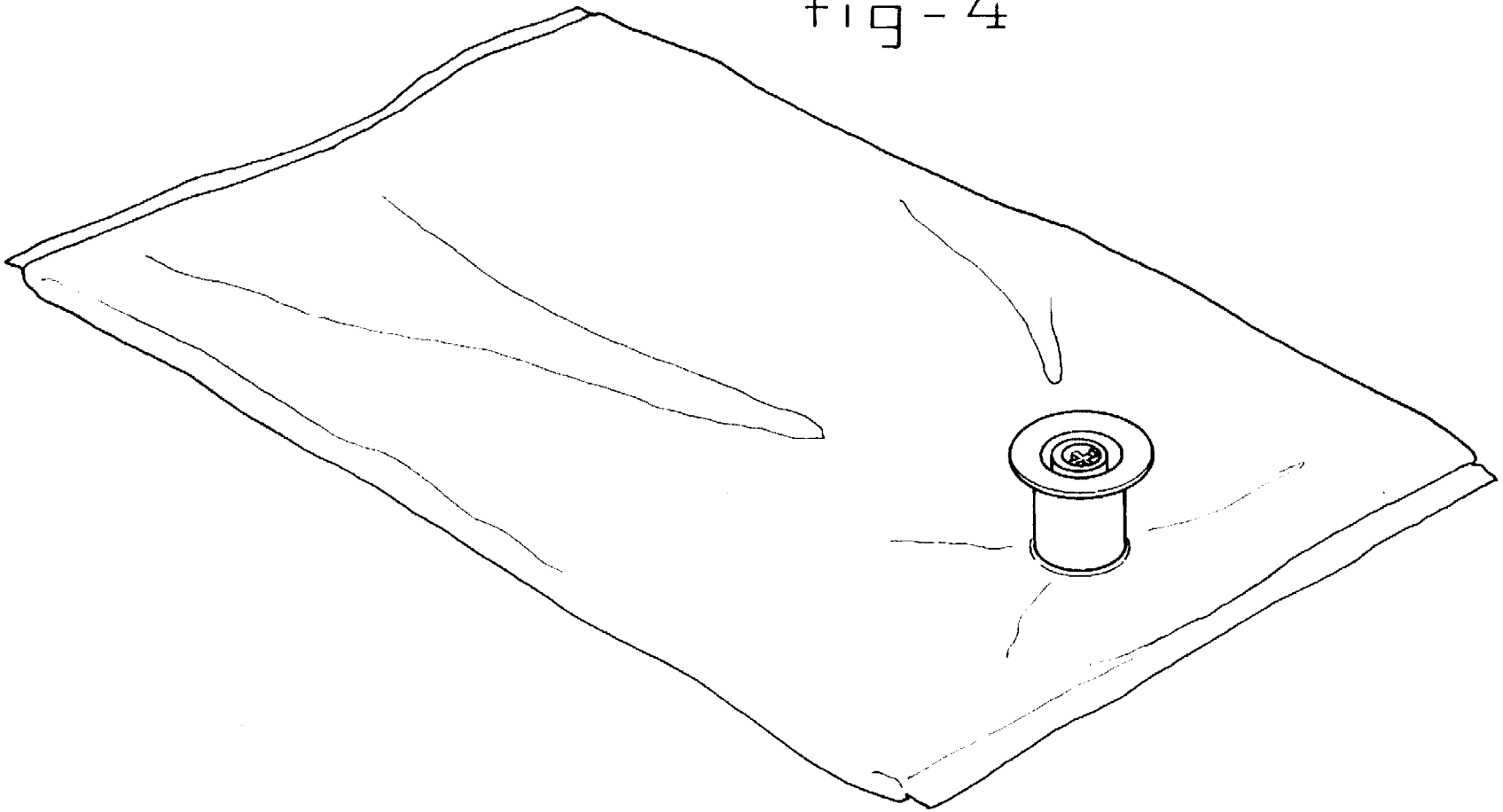
FIG. 4 shows diagrammatically the flexible bag according to the present invention, having fitted thereon the coupling means in the transporting position.

FIG. 4 shows the container bag ready for transportation, with the sleeve welded onto it. The piercing means are fitted in said sleeve.

Although the invention is described above with reference to one embodiment, it must be understood that numerous modifications can be made to it without going beyond the scope of the present application. In particular, as regards the actual pumping part, the dispensing device can be designed in any other way known in the prior art. Besides, as already stated above, the piercing point 26 can be a different part from sleeve 20. In such a case measures must be taken to hold piercing piece 23 inside sleeve 20. This can be achieved by, for example, a slightly clamping connection, or by fitting a peripheral edge below piercing piece 23 or peripheral projections in sleeve 20.

It is clear from the above that the piercing piece is used only once.

We claim:

1. Dosing unit comprising a dispensing device and a container bag unit, the container bag unit having an imperforate wall, a sleeve-shaped part having an opening therethrough, said sleeve-shaped part being secured to said wall, said wall closing one end of said opening of said sleeve-shaped part, a piercing element with a point, said piercing element being disposed entirely within said opening of said sleeve with said point directed toward said wall, said dispensing device comprising a hollow tube receivable within the end of said sleeve-shaped part opposite said wall to engage said piercing element and to move said piercing element relative to said sleeve to pierce said wall to permit the flow of contents of said bag unit through said sleeve-shaped part and through said hollow tube, said hollow tube sealing within said sleeve when moving said piercing element.

2. Dosing unit according to claim 1, said hollow tube moving said piercing element to a position entirely within said container bag unit.

3. Dosing unit according to claim 2, said piercing element being loose within said container bag unit after having been moved by said hollow tube.

* * * * *